United States Patent [19]

Chidsey, Jr.

[11] 4,294,398

[45] Oct. 13, 1981

[54] PARTITION FOR CARRIER CARTON

[75] Inventor: Francis A. Chidsey, Jr., Devon, Pa.

[73] Assignee: Container Corporation of America, Chicago, Ill.

[21] Appl. No.: 227,542

[22] Filed: Jan. 22, 1981

[51] Int. Cl.[3] ..... B65D 5/48; B65D 71/00; B65D 25/04

[52] U.S. Cl. ..... 229/15; 229/42

[58] Field of Search ..... 229/15, 42, 28 BC

[56] References Cited

U.S. PATENT DOCUMENTS

| | | | |
|---|---|---|---|
| 3,166,228 | 1/1965 | Weiss | 229/15 |
| 3,352,473 | 11/1967 | Graser | 229/15 |
| 3,478,947 | 11/1969 | Schillinger | 229/15 |
| 3,868,055 | 2/1975 | Lamgen et al. | 229/42 X |
| 4,144,995 | 3/1979 | Tavis | 229/15 |
| 4,172,546 | 10/1979 | Oliff | 229/28 BC |
| 4,209,125 | 6/1980 | Helms | 229/42 X |

*Primary Examiner*—Davis T. Moorhead

*Attorney, Agent, or Firm*—Richard W. Carpenter; Davis Chin

[57] ABSTRACT

A partition arrangement including a paperboard partition having alternately arranged longitudinal and transverse members each with projecting elements to prevent contact between adjacent articles which are arranged in side-by-side rows regardless of whether the areas of tangency are near the top, bottom or center of the partition.

1 Claim, 9 Drawing Figures

PARTITION FOR CARRIER CARTON

BACKGROUND OF THE INVENTION

1. Field of the Invention

This invention relates to partition arrangements, and, more particularly to a paperboard partition device used for separating from contact with each other adjacent areas of fragile articles, such as bottles or the like, which are arranged in side by side rows within an outer package or carton.

2. Description of the Prior Art

This invention represents an improvement in the type of partition device disclosed in the U.S. Pat. No. 4,209,125.

SUMMARY OF THE INVENTION

An object of the present invention is to provide, in an arrangement of the type described, a one piece paperboard partition device which can be used with a similar device, which is in an inverted position, to prevent contact between adjacent areas of packaged articles arranged in side by side rows even though such articles may have contact areas at various heights.

A more specific object is to provide a partition which will function for bottles of different shapes.

A more specific object of the invention is to provide a partition with longitudinal and transverse members each of which have a central or main portion with a pair of projections extending from one side and at least one projection extending from the other side.

These and other objects of the invention will be apparent from an examination of the following description and drawings.

THE DRAWINGS

It will be understood that, for purposes of clarity, certain elements may have been intentionally omitted from certain views where they are believed to be illustrated to better advantage in other views.

DESCRIPTION OF THE INVENTION

Figure 1:
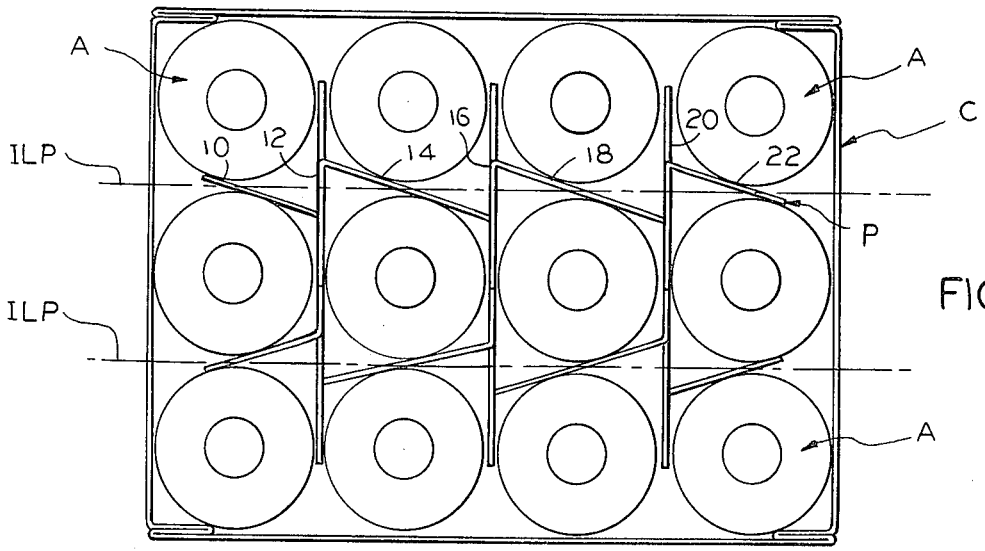
FIG. 1 is a top plan view of an outer container holding twelve packaged articles, such as bottles, arranged in three side by side rows of four articles in a row, with adjacent articles of each row and adjacent articles of adjacent rows separated by a pair of partitions embodying features of the invention.

Referring now to the drawings for a better understanding of the invention, and particular to FIG. 1, it will be seen that the novel partition embodying features of the invention, and indicated generally at P, is shown as positioned between adjacent rows of packaged articles A which are arranged within an outer container C. The lines identified by the Letters ILP indicate imaginary vertical planes located between the rows of packaged articles A.

Figure 2:
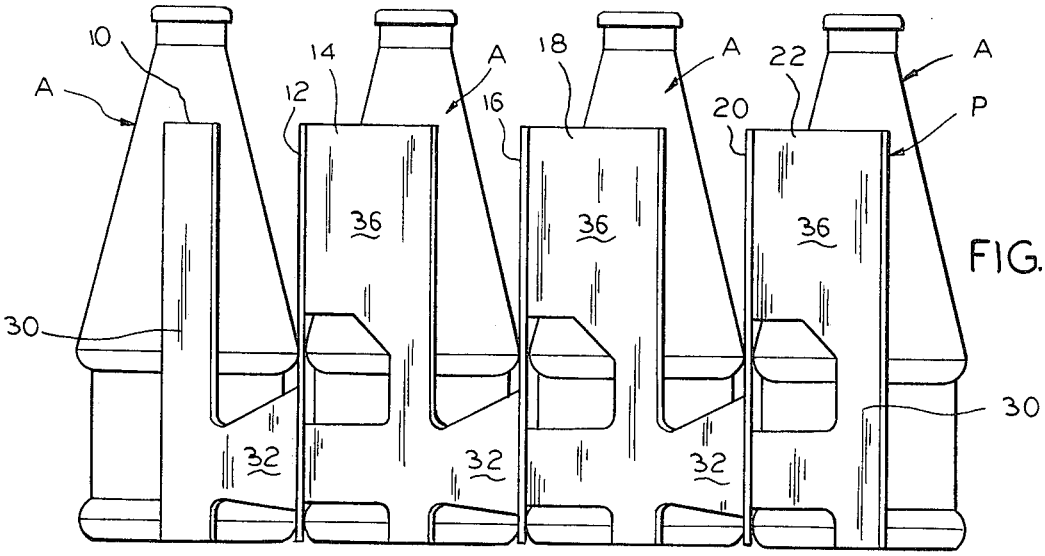
FIG. 2 is a fragmentary side elevation of the structure illustrated in FIG. 1.
Figure 6:
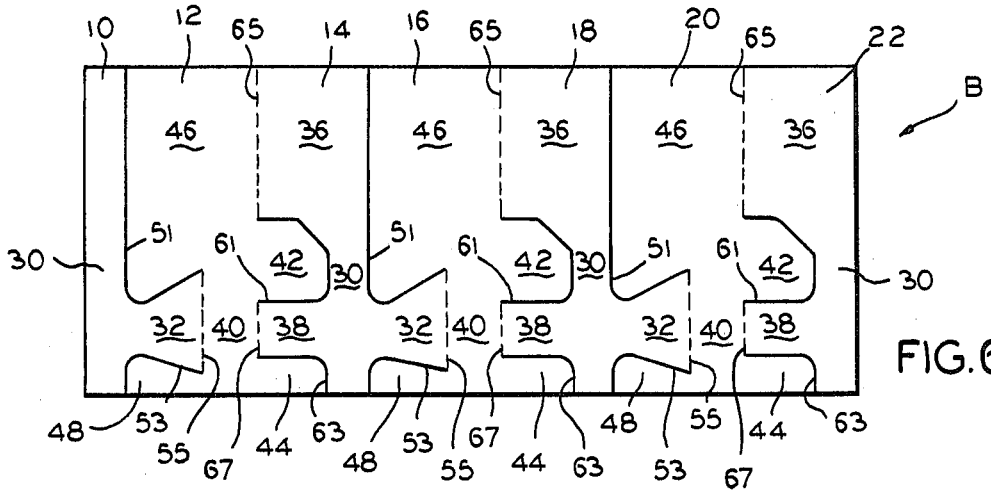
FIG. 6 is a plan view of a blank of foldable sheet material from which the partition illustrated in the other views may be formed.
Figure 7:
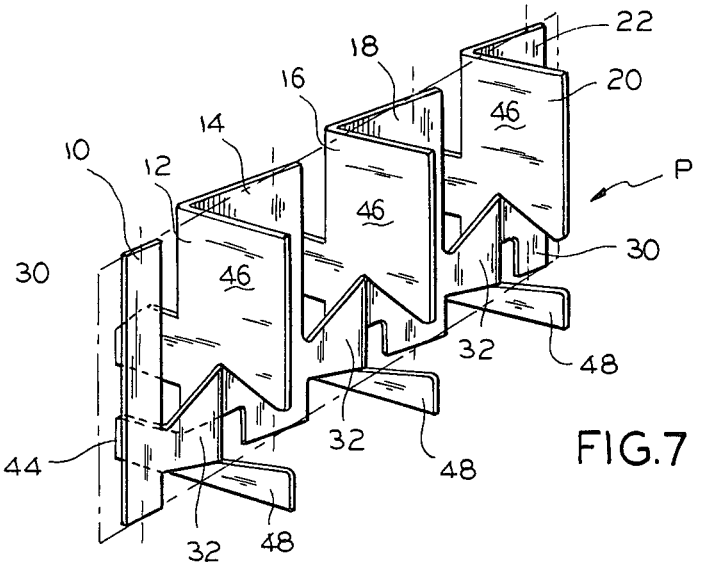
FIG. 7 is a perspective view of the erected partition shown in the other views and formed from the blank illustrated in FIG. 6.

As best seen in FIGS. 6 and 7, partition P made from blank B includes: partial first longitudinal member 10, a complete first transverse member 12, a complete second longitudinal member 14, a complete second transverse member 16, a complete third longitudinal member 18, a complete third transverse member 20, and a partial fourth longitudinal member 22. Each longitudinal partition member includes a relatively narrow, elongated main or center element or section which extends from the upper end of the partition to the lower end of the partition. Each complete longitudinal member also includes one separator element 32, which extends from the right side of the main section, as seen in FIG. 2, toward the center of the packaged articles, and a pair of separator elements 36 and 38 which extend from the left side of the main section with element 36 extending toward the upper and center portions of the articles and element 38 extending toward the lower portions of the articles.

Figure 3:
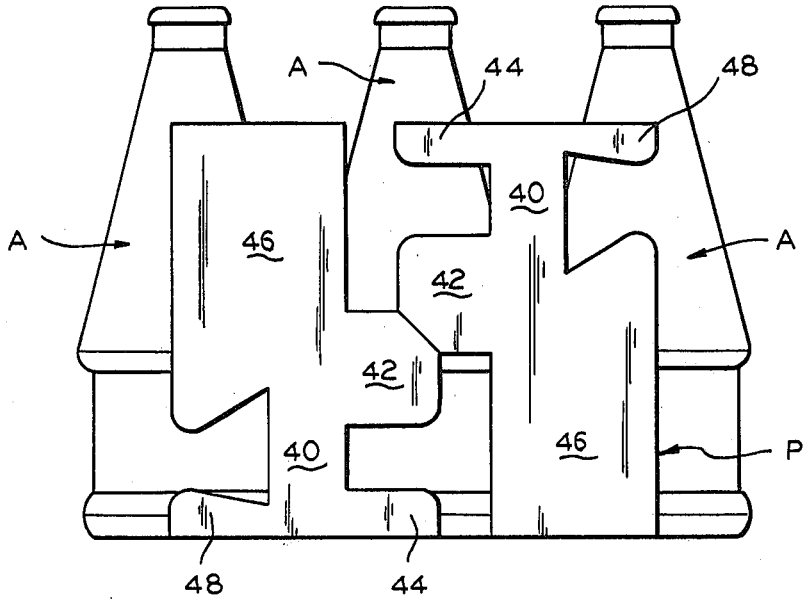
FIG. 3 is a fragmentary end elevation of the structure illustrated in FIG. 1.

Each transverse member includes a relatively narrow, elongated main or center element or section 40, extending from the upper end to the lower end of the partition; and also a pair of separator elements 42 and 44 which extend from the right side of the main section, with element 42 extending toward the center and element 44 extending toward the lower portion of the articles; and a pair of separator elements 46 and 48 extending from the left side of the main section, with element 46 extending toward the upper and center portions of the articles and element 48 extending toward the lower portion of the articles, as best seen in FIG. 3.

Still referring to FIG. 3, it will be seen that section 30 and element 32 of each longitudinal member are separated from element 46 of the adjacent transverse member by a cutline 51. Likewise, section 30 and element 32 of each longitudinal member are separated from element 48 of the adjacent transverse member by a cutline 53. Also, longitudinal member element 32 is joined to section 40 of the adjacent transverse member by a fold line 55. At the other side of each transverse member it will be seen that section 30 and elements 36 and 38 of each longitudinal member are separated from section 42 of adjacent transverse member by a cutline 61. Also section 30 and element 38 are separated from section 44 of adjacent transverse member by a cutline 63. Further it will be seen that each longitudinal element 36 is joined to related section 40 of adjacent transverse member by a fold line 65, and each longitudinal element 38 is joined to a related section 40 of adjacent transverse member by another fold line 67.

Figure 5:
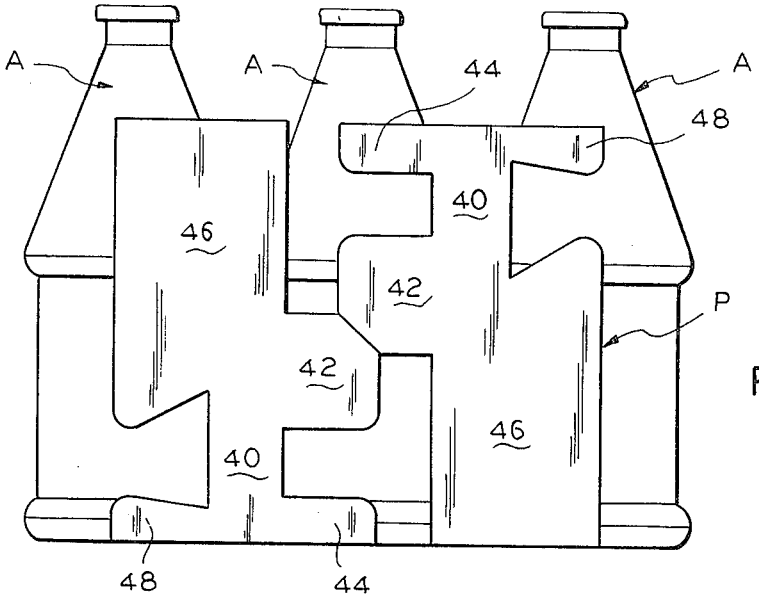
FIGS. 4 and 5 are views similar to FIG. 3 but illustrating the novel partition as shown with packaged articles having slightly different configurations than the packaged articles illustrated in the previous views.
Figure 4:
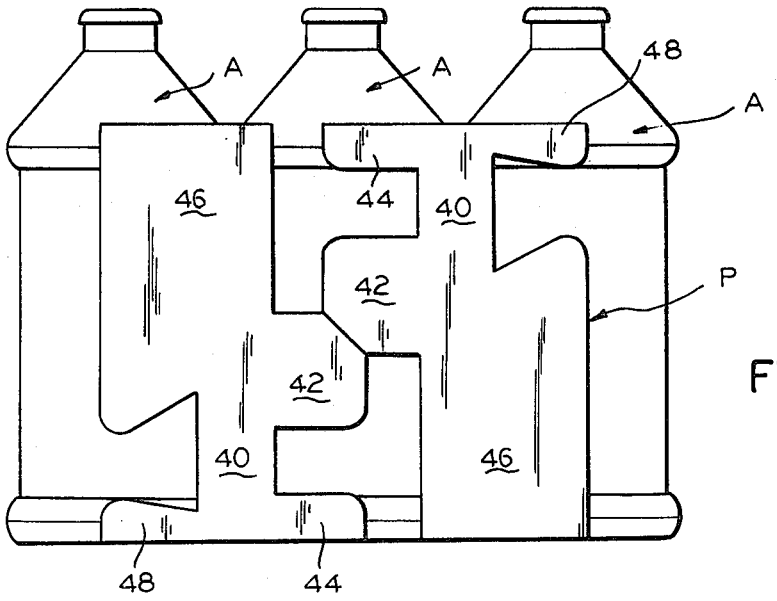

Thus, it will be seen that when the partition is assembled with the longitudinal and transverse members folded, as shown in FIG. 7, and inserted within a container between adjacent rows of articles A, as shown in FIG. 1, the result is that adjacent articles of the same as well as adjacent rows are separated from each other by the various members of the partition. The partition is particularly suitable for a three row arrangement when used with a similar partition placed in an inverted position. This is best illustrated in FIG. 3, where the transverse members of two similar partitions are shown cooperating, with one of the partitions being in an inverted position whereby the various projections of the two partitions cover the points of tangency between adjacent articles whether they are in the center and bottom, as shown in FIG. 3, or at the top and bottom, as shown in FIG. 4, or at the center and the bottom, as shown in FIG. 5. Thus, by this novel arrangement, an all purpose partition is provided which, when used with another similar partition in an inverted position, will separate various points of tangency between adjacent articles arranged in three side-by-side rows.

Figure 8:
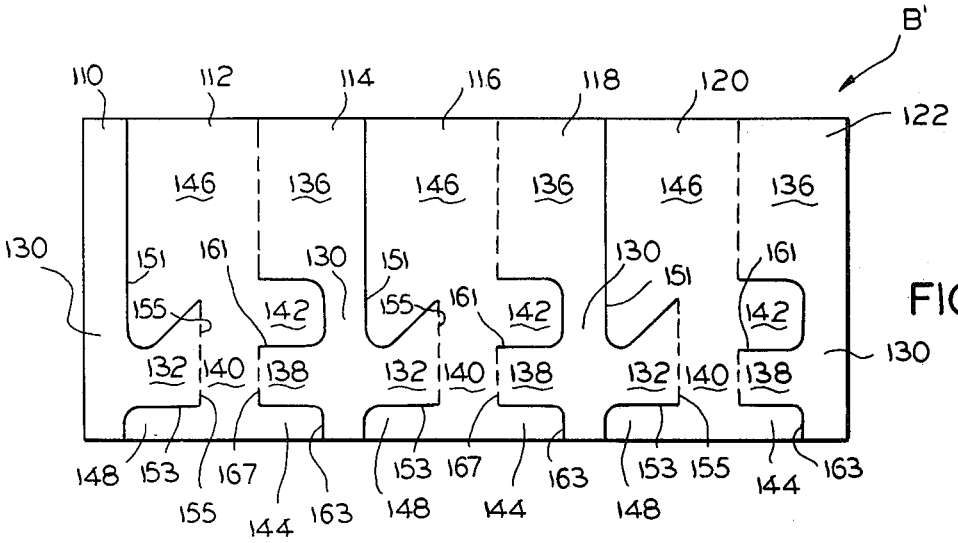
FIGS. 8 and 9 are views similar to FIGS. 6 and 3, but illustrate a slightly modified form of the invention.
Figure 9:
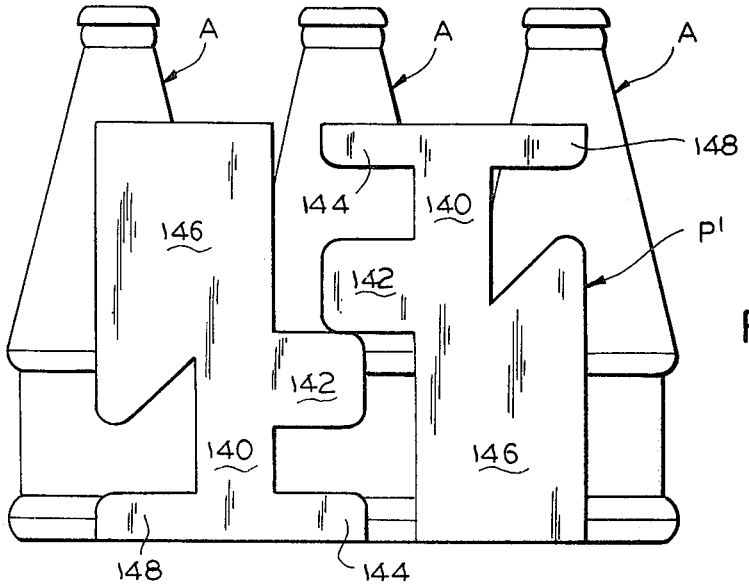

Turning now to FIGS. 8 and 9, it will be seen that a slightly modified form of the partition is shown. In this embodiment numerals similar to those used for the previous embodiment have been employed to designate corresponding elements. The difference between this partition and that previously described embodiment is in the specific contour of the elements 142 of the transverse members of partition P′ made from blank B′. This embodiment functions in the same manner as that of the previously described embodiment.

I claim:

1. In a partition arrangement for separating corresponding areas of adjacent packaged articles, such as bottles, arranged in three side-by-side rows, a pair of partitions, each being formed of a unitary blank of paperboard or the like which is cut and scored to provide:

(a) a plurality of alternately disposed longitudinal members, for interposition between adjacent articles of separate rows, and transverse members, for interposition between adjacent articles of the same row;

(b) each of said members having a relatively narrow main section, extending the entire height thereof, and separator elements projecting laterally outward from opposite sides thereof;

(c) said transverse member each having a pair of separator elements extending from one side of said main section toward upper end, center, and lower end areas of the articles and another pair of separator elements extending from the other side of said main section toward center and one of the end areas of the articles, so that when said partition is used with a similar partition, disposed in an inverted position, the elements extending from said other side of said partition main sections cooperate to prevent contact between corresponding areas of adjacent articles of the center row, at the center and both the upper and lower end areas of said partitions.

* * * * *